United States Patent [19]

Minnee

[11] Patent Number: 4,778,121

[45] Date of Patent: Oct. 18, 1988

[54] GUIDING ON DEVICE FOR WINCHDRUM

[76] Inventor: Jan F. Minnee, Kon. Astrid Boulevard 26A, NL-2202 BH Noordwijk aan Zee, Netherlands

[21] Appl. No.: 4,833

[22] Filed: Jan. 13, 1987

Related U.S. Application Data

[63] Continuation of Ser. No. 691,526, filed as PCT NL83/00013 filed on Apr. 7, 1983, published as WO84/03876 on Oct. 11, 1984, abandoned.

[51] Int. Cl.[4] ..... B65H 54/28; B65H 57/28

[52] U.S. Cl. ..... 242/157.1

[58] Field of Search ..... 242/157.1, 158 R, 158.3

[56] References Cited

U.S. PATENT DOCUMENTS

| | | | |
|---|---|---|---|
| 2,249,117 | 7/1941 | Crandall | 242/157.1 |
| 2,336,684 | 12/1943 | Hendrickson | 242/157 |
| 2,473,628 | 6/1949 | Allison | 242/157.1 |
| 3,078,060 | 2/1963 | Le Bus, Sr. | 242/157.1 |
| 4,015,798 | 4/1977 | Benya | 242/157.1 |

FOREIGN PATENT DOCUMENTS

| | | | |
|---|---|---|---|
| 346029 | 10/1978 | Austria . | |
| 892791 | 10/1953 | Fed. Rep. of Germany | 242/157.1 |
| 852346 | 1/1940 | France . | |
| 993133 | 10/1951 | France . | |
| 1016031 | 8/1952 | France | 242/157.1 |
| 1299936 | 6/1962 | France . | |
| 2185583 | 5/1971 | France . | |
| 2094089 | 6/1971 | France . | |
| 453668 | 10/1965 | Switzerland . | |
| 526862 | 9/1940 | United Kingdom | 242/157.1 |

*Primary Examiner*—Stanley N. Gilreath

*Attorney, Agent, or Firm*—Fleit, Jacobson, Cohn & Price

[57] ABSTRACT

A cable guide device is movably interposed between a drum and a fixed sheave which is located at a substantial distance in front of the drum. The cable guide device includes a frame for supporting a cable and a support surface for supporting the frame. The frame is subjected to an oscillating movement with respect to the support surface when the cable is wound onto the drum. The frame includes a guider sheave at one end for guiding the cable during winding and unwinding of the cable onto and from the drum. The frame further includes a convex surface sector at another end, opposite to the first end, extending transverse to the direction of winding and unwinding of the cable for engaging the support surface.

1 Claim, 2 Drawing Sheets

GUIDING ON DEVICE FOR WINCHDRUM

This application is a continuation of application Ser. No. 691,526, filed as PCT NL83/00013 on Apr. 7, 1983, published as WO84/03876 on Oct. 11, 1984, now abandoned.

BACKGROUND OF THE INVENTION

The present invention is directed to an appliance for winding a cable evenly over the full length of a drum in cases where the fleet angle exceeds approximately 4° or where the distance of a lead or fixed lead sheave 2 in front of the drum 3 is shorter than approximately 7 times the drum length, as shown in FIG. 1, where X is the drum length and Y equals the distance between the fixed lead sheave and the drum.

Conventional spooling arrangements adjust the wire position opposite the drum by means of mechanical drives; in the present invention, however, the appliance of cable is directed solely by the previously laid-on drum winding of cable, and all other influences are eliminated.

The spooling of cable on a drum is fulfilled for the present invention if, in any position of the spooling gear between drum 3 and fixed lead sheave 2, the total length of wire between the meeting points on drum and sheave remains constant, as shown in FIG. 2, where $a+c=a'+c'$. a and a' are the length of cable between fixed lead sheave 2 and movable lead sheave 1. c and c' are the length of cable between drum 3 and movable lead sheave 1. a and c illustrate a different position of the wire on the movable lead sheave 1 as compared to $a'+c'$.

The taut cable always seeks the shortest distance between those two points (the fixed lead sheave 2 and the drum 3), and, if this does not exist, there will be no preference for any position at all. The spooler, apart from moving along the drum, must therefore also travel along a path such that the distance $a+c$ of the cable remains constant. This path lies in a plane perpendicular to the cable and proves to be almost circular, with a radius depending on the distance between the fixed lead sheave and the drum and the angle of the cable between the spooler fixed lead sheave 2 and the drum 3.

Because the force generated by the cable on the spooler should not influence the movement of the cable, it is necessary that the direction of this force is perpendicular to the path of the cable and should not cause interfering resistances along the path.

A well-known device fulfilling these conditions, as shown in FIGS. 1 and 2, produces the required path for the cable by means of a movable lead sheave 1 rotating and translating along a shaft 50 which, in turn, by means of a crank shaft 52 securely placed at one end to shaft 50 and at the other end to movable lead sheave 1, makes an oscillating movement along the path of arrow 54 in front of the drum 3, the path of travel of the cable being governed by the length and angle of the crank shaft 52.

The use of swiveling bearings for the mounting of the movable lead sheave 1 on crank shaft 52 restricts the length of the crank shaft 52 in comparison with the drum length so that Y is greater than 2.4X.

For long length X drums and high loads, special high tensile materials are required. In addition, complicated dismounting and provisions are necessary for maintaining the proper position of the movable lead sheave 1 when the cable slackens.

SUMMARY OF THE INVENTION

The invention is directed to a device with applications where $X=Y$, merely depending on the running of the cable over the movable lead sheave 1, with the aim of achieving more compact winch arrangements by simpler means to minimize the distance of the cable between the fixed lead sheave 2 and the drum 3.

The required path for the cable is produced by a "tumbler" sheave 10, as shown in FIGS. 3–7, pivoting on a foundational transverse rail 14 in front of the drum 18.

The number of layers of the cable on the drum determines where the cable will wind onto the drum. If the point where the cable contacts the drum is aligned above mid-height of the tumbler sheave 10, the cable will have a preference to be directed to the central part of the drum when the drum is empty, whereas when the cable is guided onto a full drum of the wire, the cable will have a preference to be directed to the sides of the drum.

The tendency of the wire to move to the sides of a full drum may be useful in cases where a mechanically driven tumbler spooler may be advantageous in comparison with the usual transverse guiding-on gear with diamond-threaded drive shaft 60, where the required force to feed a cable onto a drum is great (FIG. 5).

DETAILED DESCRIPTION OF THE DRAWINGS

Figure 1:
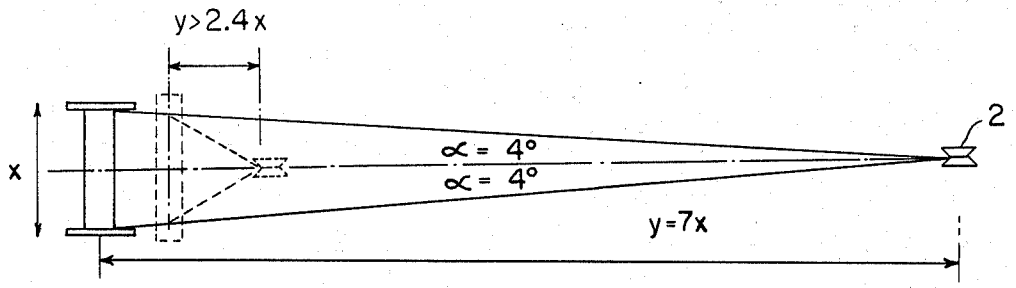
FIG. 1 (PRIOR ART)
FIG. 1 illustrates an overhead view of a drum, movable sheave, and fixed lead.
Figure 2:
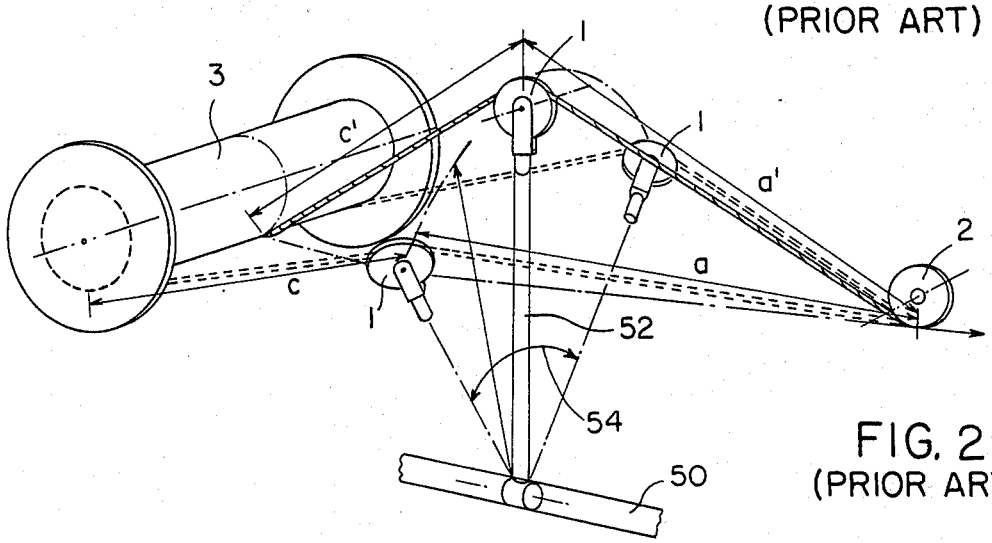
FIG. 2 (PRIOR ART)
FIG. 2 illustrates a perspective view of a drum, movable sheave, and fixed lead, with a cable and the sheave being shown in three positions.
Figure 3:
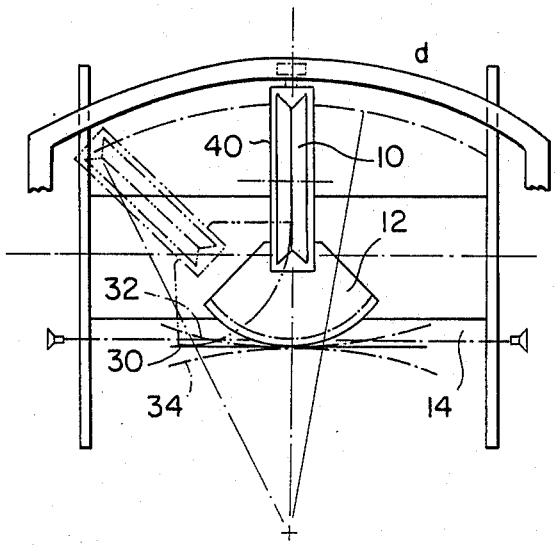
FIG. 3 illustrates a front view of the tumbler assembly of the present invention.

A practical way of producing the required path of cable for the present invention is found in a tumbler sheave 10 rotatably mounted within sheave housing 40, not having a fixed hinge pin, but a convex surface sector 12 connected at one end to sheave housing 40, which, while rocking across a curved U-shaped top rail 24 engaged by projection 22 connected to an opposite end of sheave housing 40, is also rolling over a bottom transverse rail 14 having a flat 30, convex 32, or concave 34 support surface (as shown in FIG. 3), thus reducing support pressure by spreading the support pressure over a large convex surface, and enabling the surface sector 12 to be counterbalanced so that when cable 16 slackens, the cable and the convex surface sector 12 remain in their original position when they were under a tension force (FIG. 3).

Structurally, the generated forces in the tumbler sheave 10 do not require the use of special materials or parts.

Figure 5:
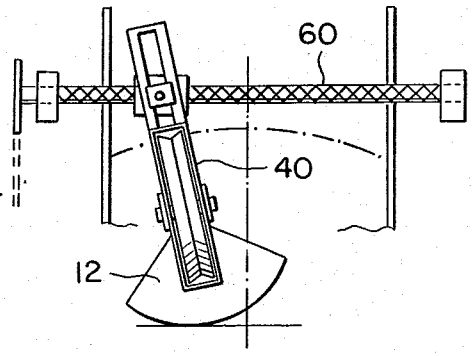
FIG. 5 illustrates a tumbler spooler.
Figure 4:
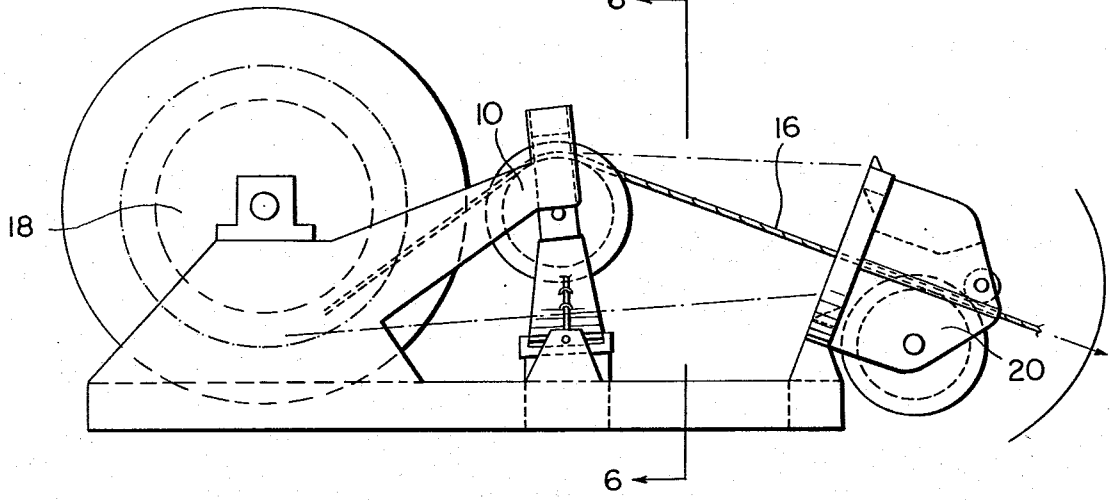
FIG. 4 illustrates a side view of a compact winch arrangement.

FIG. 4 presents a compact winch arrangement, while FIG. 5 shows a different embodiment of a tumbler spooler with a mechanical self-adjustable external drive (not shown) which drives drive shaft 60.

Figure 6:
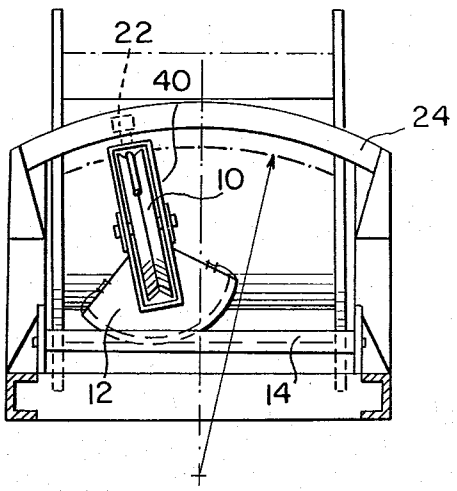
FIG. 6 illustrates a view of FIG. 4 taken along line 6—6.
Figure 7:
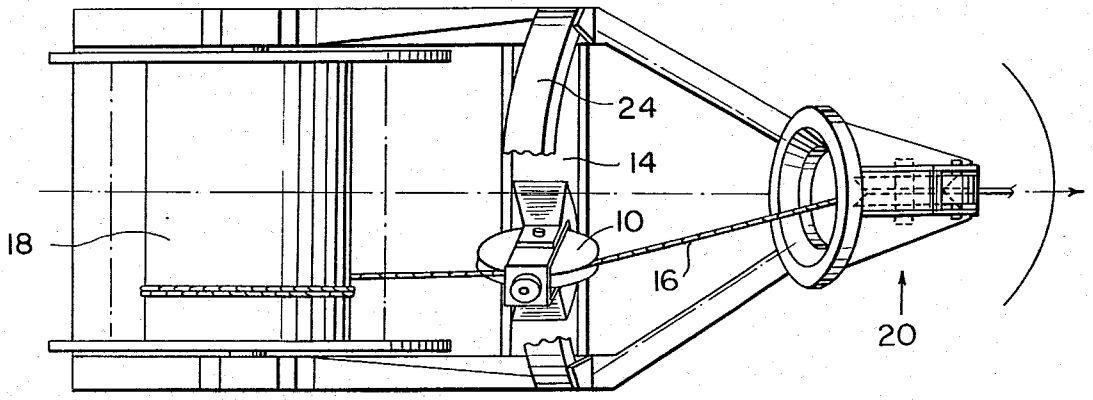
FIG. 7 illustrates a plan view of FIG. 4.

In FIGS. 4, 6, and 7, a cable rides upon a guider tumbler sheave 10 which is located between a drum 18 and a fixed lead cable sheave 20. The guider tumbler sheave 10 is set into a frame 30, the sheave 10 having at the bottom of the sheave housing a convex surface sector 12 which bears against, as shown in FIG. 6, a flat support surface transverse rail 14. As drum 18 is rotated, the cable is fed onto the drum after crossing over the top surface of the guider tumbler sheave 10. The cable chooses the path of shortest distance as guided by the guider tumbler sheave. The guider tumbler sheave housing and connected convex surface sector oscillates as the cable is fed onto the drum. Further, a center point of the guider tumbler sheave moves along a curved line during the winding of the cable 16 onto the drum 18. As shown in FIG. 3, the support surface for the convex portion of the guider tumbler sheave frame may be either flat, convex, or concave.

The oscillating movement of the guider tumbler sheave housing reduces the required physical dimension of the cable spooling device and reduces the support pressure required by spreading the support pressure over a large surface area which supports the convex surface sector bottom of the guider tumbler sheave frame assembly. Further, the guider tumbler sheave frame is counterbalanced so that when the cable slackens, the guider tumbler sheave frame assembly remains in its original position without affecting the cable being wound onto a drum.

Therefore, the system of the present invention ensures that the guider tumbler sheave frame is kept in front of the winder drum to ensure lateral stability. The bottom convex portion of the convex surface sector 12 is caused to swing gradually across its support surface, to swivel the guider tumbler sheave 10 to a correct angle in which the cable is running form the fixed lead sheave to the drum.

I claim:

1. A cable guide device adapted to be movably interposed between a drum and a cable lead which is located in front of said drum, said cable guide device comprising:

a guider tumbler sheave assembly for supporting a cable fed towards a drum, a drum for receiving said cable from said guider tumbler sheave assembly, said guider tumbler assembly including a frame, a guider sheave, a sheave housing, and a convex surface sector, said guider sheave being rotatably mounted in said sheave housing, said frame having a curved top rail and a bottom support surface means for supporting said convex surface sector, said support surface means being flat and said convex surface sector being movable on said support surface means to subject said convex surface sector and said guider sheave to an oscillating movement with respect to said support surface means when said cable is wound onto said drum, and one end of said sheave housing including a projection engaging said curved top rail during winding of said cable onto said drum, and another opposite end of said sheave housing being connected to said convex surface sector, said convex surface sector extending transverse to the direction of winding of said cable and rocking on said support surface means during winding of said cable onto said drum.

* * * * *